US005251762A

United States Patent [19]

Taylor et al.

[11] Patent Number: 5,251,762

[45] Date of Patent: Oct. 12, 1993

[54] ELECTROSTATIC SEPARATION OF PARTICLES

[75] Inventors: Joseph B. Taylor, Neptune Beach; Arnold H. Jackson, Jacksonville, both of Fla.

[73] Assignee: Carpco, Inc., Jacksonville, Fla.

[21] Appl. No.: 863,064

[22] Filed: Apr. 3, 1992

[51] Int. Cl.[5] ..... B03C 7/00

[52] U.S. Cl. ..... 209/127.4; 209/128

[58] Field of Search ..... 209/127.1, 127.4, 128, 209/129, 130; 15/15.1

[56] References Cited

U.S. PATENT DOCUMENTS 2,706,044 4/1955 Cook, Jr. ..... 209/127
2,786,575 3/1957 Roberts ..... 209/127.1
2,803,344 8/1957 Morrison ..... 209/127.4
2,813,626 11/1957 Johnson et al. ..... 209/127.4
3,253,201 5/1966 Slatkin ..... 209/127.1

FOREIGN PATENT DOCUMENTS 1154052 9/1963 Fed. Rep. of Germany .
1151311A 6/1983 U.S.S.R. .

*Primary Examiner*—Robert P. Olszewski
*Assistant Examiner*—Kenneth Noland
*Attorney, Agent, or Firm*—Arthur G. Yeager

[57] ABSTRACT

Apparatus for separating one type of particle from a mixture of particle types by dropping the mixture through a free fall zone between two spaced vertical walls of electrostatically charged, vertical cylindrical, spaced, continuously rotating electrodes that are continuously brushed by a plurality of spaced vertical cylindrical continuously rotating brushes.

17 Claims, 4 Drawing Sheets

ELECTROSTATIC SEPARATION OF PARTICLES

BACKGROUND OF THE INVENTION

This invention relates to the technology of separating particles by means of attraction and repulsion forces applied to the particles in an electrostatic field.

The prior art is well aware of the general concept of passing particles through an electrostatic field to cause the particles, having electrical charges associated therewith, to move toward or away from charged electrodes in accordance with the principles of electrostatics (like charges repel and dissimilar charges attract). Typical of the U.S. Pat. Nos. in this field of technology are 2,245,200; 2,357,658; 3,998,727; and 4,092,241. Improvements in the apparatus for such processes have been directed to many features, such as the use of special transportation means to carry the particles through the electrostatic field, vibration equipment to assure random mixing of particles fed into the system, etc. Typical of such improvements is that of U.S. Pat. No. 4,849,099. Still other improvements have been needed.

It is an object of this invention to provide an improved apparatus for effecting electrostatic separation of particles from a mixture of particles. Another object of this invention is to provide an electrostatic separation apparatus having continuous cleaning of the electrodes. Still another object is to provide an improved apparatus made into modules that can be added to other modules to produce an apparatus of any desired capacity. Other objects will become apparent from the more detailed description which follows.

BRIEF SUMMARY OF THE INVENTION

This invention relates to an apparatus for electrostatically separating a feed mixture of two types of particles which comprises feeding the particles into the upper feed end of a vertical free fall zone having an upper feed end and a lower discharge end between two horizontally spaced rows of a plurality of spaced rotating vertical-axis elongated cylindrical electrodes, said lower discharge end having a splitter coextensive with said discharge end, and recovering two separated products, each of different types of particles originally in said feed mixture, said rotating electrodes being continuously cleaned by a plurality of vertically positioned, rotating, elongated cylindrical brushes contacting said electrodes, and means for rotating said electrodes and said brushes and means for applying an electric charge to said electrodes.

In specific and preferred embodiments of this invention the electrodes and the brushes rotate in opposite directions with respect to each other; the apparatus is housed in an open-ended structure to form a module that is attachable at its open ends to other like modules; the electrodes and brushes are arranged in units of two spaced electrodes and one brush contacting both electrodes; and the brushes are manually adjustable toward and away from the contacted electrodes.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
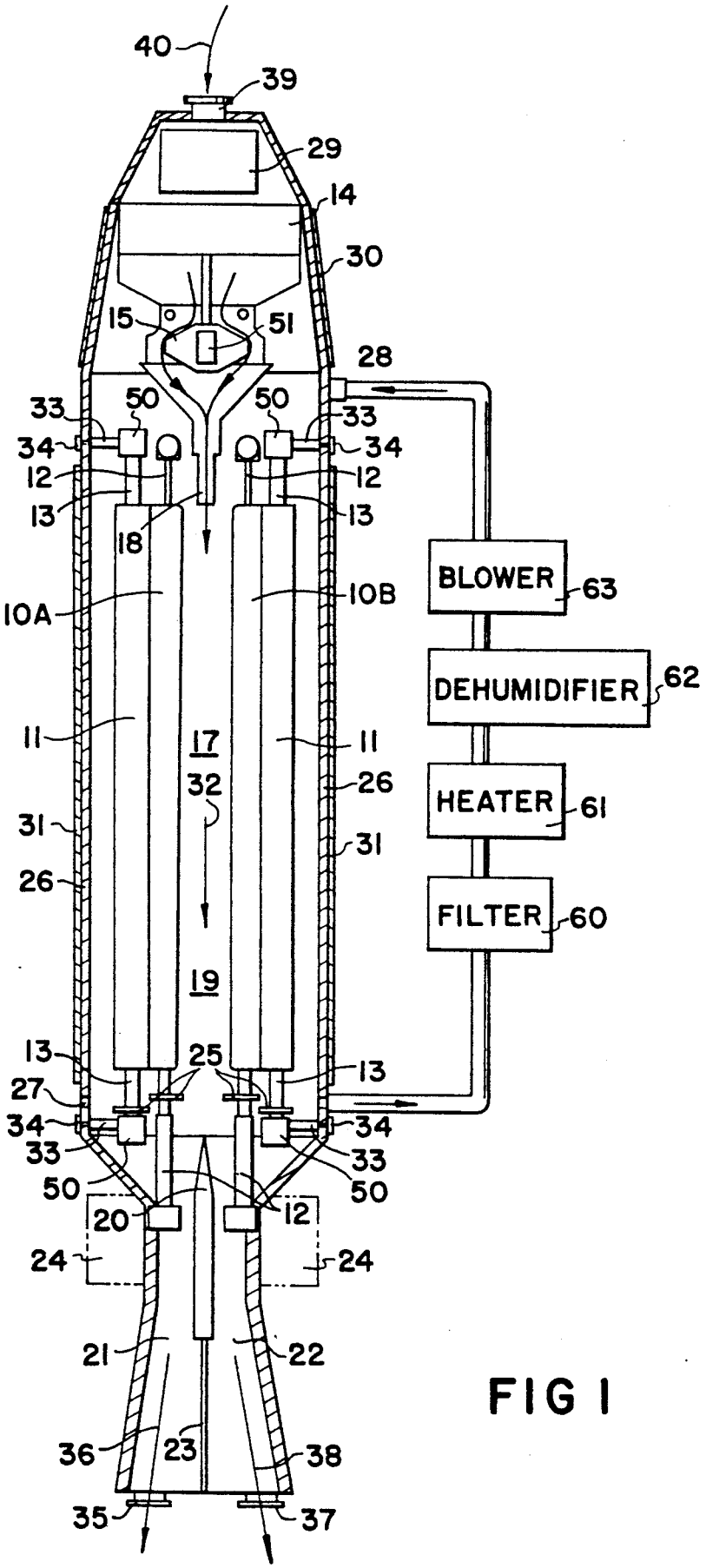
FIG. 1 is an end elevational view of the apparatus and its housing according to this invention.

The features of this invention are best understood by reference to the attached drawings.

In the drawings there is shown a free fall zone 17 into which is dropped from above a mixture of particles from a feed tray 15 and at the exit 19 of which is a splitter 20 to divide the product into discharge chute 21 or discharge chute 22 for removal through parts 35 or 37, respectively.

The particles may be of any type and from any source so long as they are small enough to be dropped into zone 17 and fall freely by gravity without any substantial sidewise drifting in the fashion of an air foil. Generally, the particles should be in a size range of about ⅜ inch to 200 mesh (about 9.5 mm. to about 0.07 mm.). The particles may be natural ore, metal, limestone, calcium carbonate, silica, sodium chloride, recycled plastics, etc. The apparatus of this invention is employed to separate one type of particle from a feed mixture of two or more different types of particles, ore mixtures of metal particles, mixtures of silica particles and limestone particles, mixtures of recycled plastics, etc. Such particles normally have electrical charges associated therewith, although some particles have no such charge and are electrically neutral. The particles with charges, plus, minus, or zero are separated by passing them close to electrodes that are charged plus or minus. Separation occurs because the charged particles and the charged electrodes are attracted to or repulsed from each other in accordance with the scientific fact that like charges repel each other, and unlike charges attract each other.

In the apparatus of this invention electrodes 10 are elongate cylindrical structures, solid or tubular, arranged as spaced vertical walls 10A and 10B defining the sides of free fall zone 17. The electrodes 10 in each wall 10A and 10B are positioned with their long axes vertical, parallel to each other, and spaced apart from each other. The electrodes in wall 10A are charged oppositely from the electrodes in wall 10B. A typical lateral distance between walls 10A and 10B may be about 8–14 inches with electrodes 10 being from about 3 inch to about 6 inches in diameter. The length of electrodes 10 is variable depending on space availability and convenience, but generally are preferred to be from about 2 feet to about 10 feet long.

Figure 4:
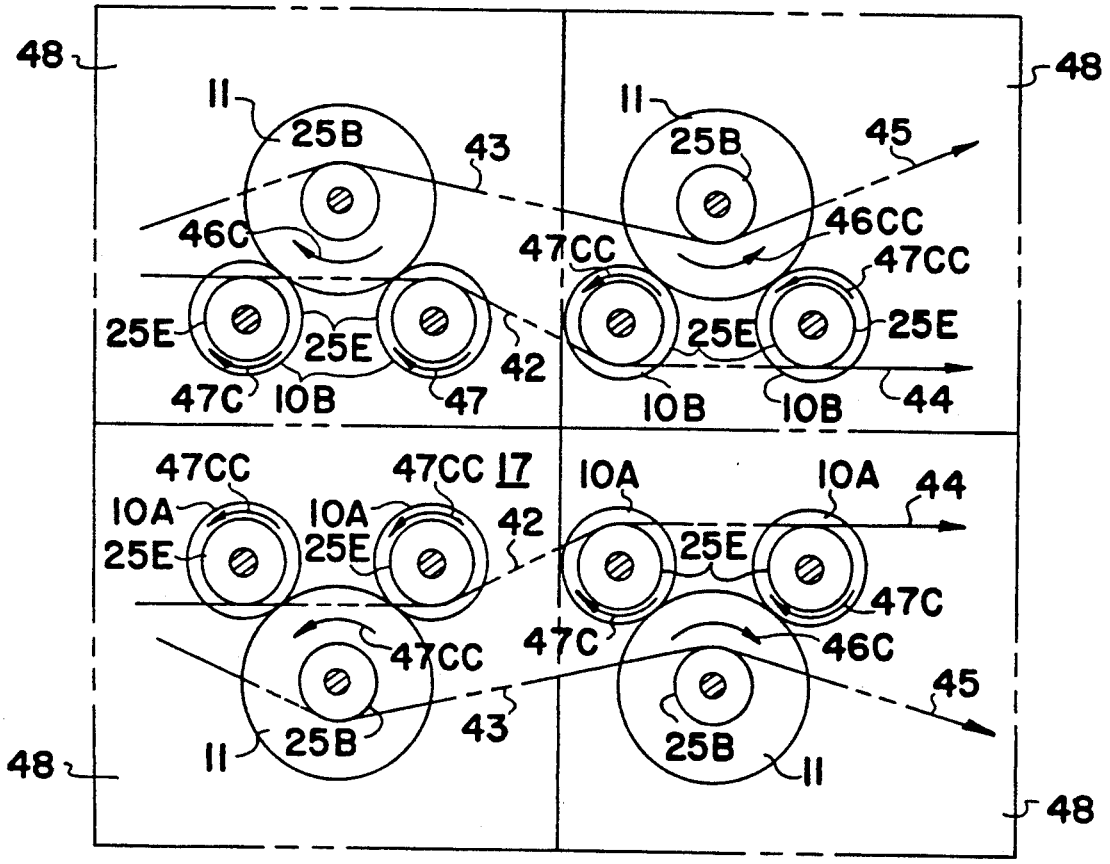
FIG. 4 is an enlarged partial view of the cross section of FIG. 3 to show a preferred arrangement and the rotational directions of the electrodes and brushes.

One of the key features of this invention is a system to keep electrodes 10 free fiom acquiring a coating of dust and other particles that might interfere with the separation efficiency of the apparatus. This system includes a plurality of elongated cylindrical brushes 11 that continuously brush away any accumulation of particles on the surface of electrodes 10. This is accomplished by continuously rotating electrodes 10 about their long axes and continuously rotating brushes 11 which are in contact with electrodes 10 on a side away from free fall zone 17. In the preferred arrangement (see FIG. 4) brushes 11 and electrodes 10 are arranged into units or modules 48 of one brush 11 for each pair of adjacent electrodes 10, the brush 11 rotating in a direction 46 opposite to the rotational direction 47 of the two cooperating electrodes 10B (FIG. 4).

Electrodes 10 and brushes 11 are rotated by any convenient driving means. In the drawings, motors 24 and speed reducers 41 drive chains 42 and 43, which engage sprockets 25E and 25B on electrode shafts 12 and brush shafts 13 to rotate electrodes 10 and brushes 11. It is preferred for the sake of efficiency to rotate brushes 11 counter to the rotation of electrodes 10. For this reason when operating in units or modules 48 of one brush 12 for two electrodes 10, (see FIG. 4), it is necessary to turn both electrodes in the same direction 47 so as to be counter to direction 46 of the one brush 11. In order to provide the optimum efficiency to meet the random mixture of falling particles it is preferred that alternate units or modules 48 have reverse directions of rotation of electrodes 10. Thus, in FIG. 4 the pair of electrodes 10B in unit or module 48 rotate in counterclockwise direction 47*cc*. The adjacent pair of electrodes 10B rotate in the clockwise direction 47*c*. On the opposite side of free fall zone 17 the same alternation of rotation occurs as between adjacent pairs of electrodes 10A. It is, however, of no importance whether the pair of electrodes 10B that is directly opposite to any one pair 10A rotate in the same or counter direction with respect to each other. Generally, the rotational speed of electrodes 10 and brushes 11 is about the same, and should be about 10–100 rpm.

Feed hopper 14 receives through inlet port 39 in the direction of arrow 40 the crude mixture of particles to be treated by the apparatus of this invention. Particles in feed hopper 14 pass from hopper 14 and along tray 15 due to vibration by vibrator 51 in the form of a rotating unbalanced motor and along the path indicated by arrows 16 through a narrow slit discharge opening between two spaced parallel plates 18 to be dropped into free fall zone 17. The parallel plates 18 provide a sufficiently long vertical passageway to eliminate substantially all lateral movement to the particles passing therethrough. This assures that the particles leaving plates 18 will drop vertically with no lateral forces applied except those due to the electrical charges from electrodes 10A and 10B. As the particles fall through zone 17, they will be attracted to or repelled from the charges of electrodes 10A and 10B, if the particles have any charge at all. Neutrally charged particles will not be affected by the charges of the electrodes 10A and 10B. By the time the charged particles reach exit 19 from zone 17 they will have moved laterally across zone 17 to effect a concentration of minus-charged particles closer to plus-charged electrodes 10A or 10B. As the falling mass of particles passes splitter 20 there is a permanent division between the particles closer to 10A and the particles closer to 10B. These divided portions fall into chutes 21 and 22 separated by wall 23 and emptied through parts 35 and 37.

Figure 2:
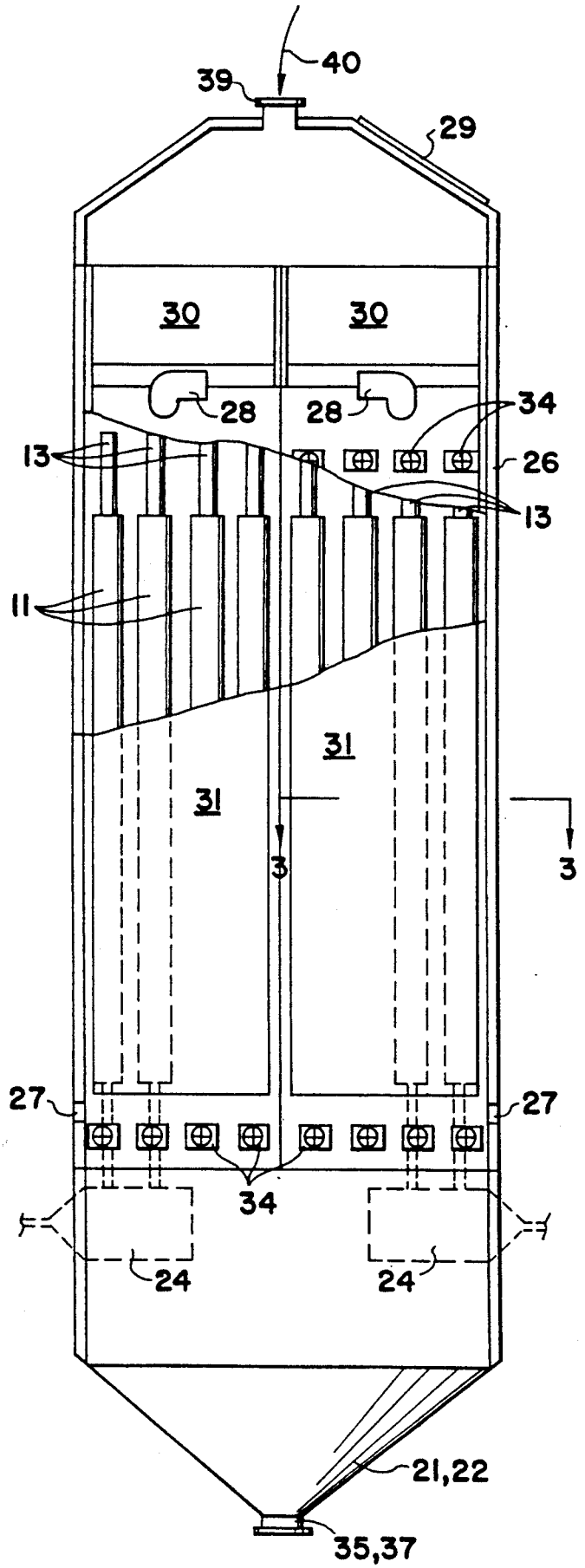
FIG. 2 is a front elevational view of the apparatus and housing of FIG. 1.
Figure 3:
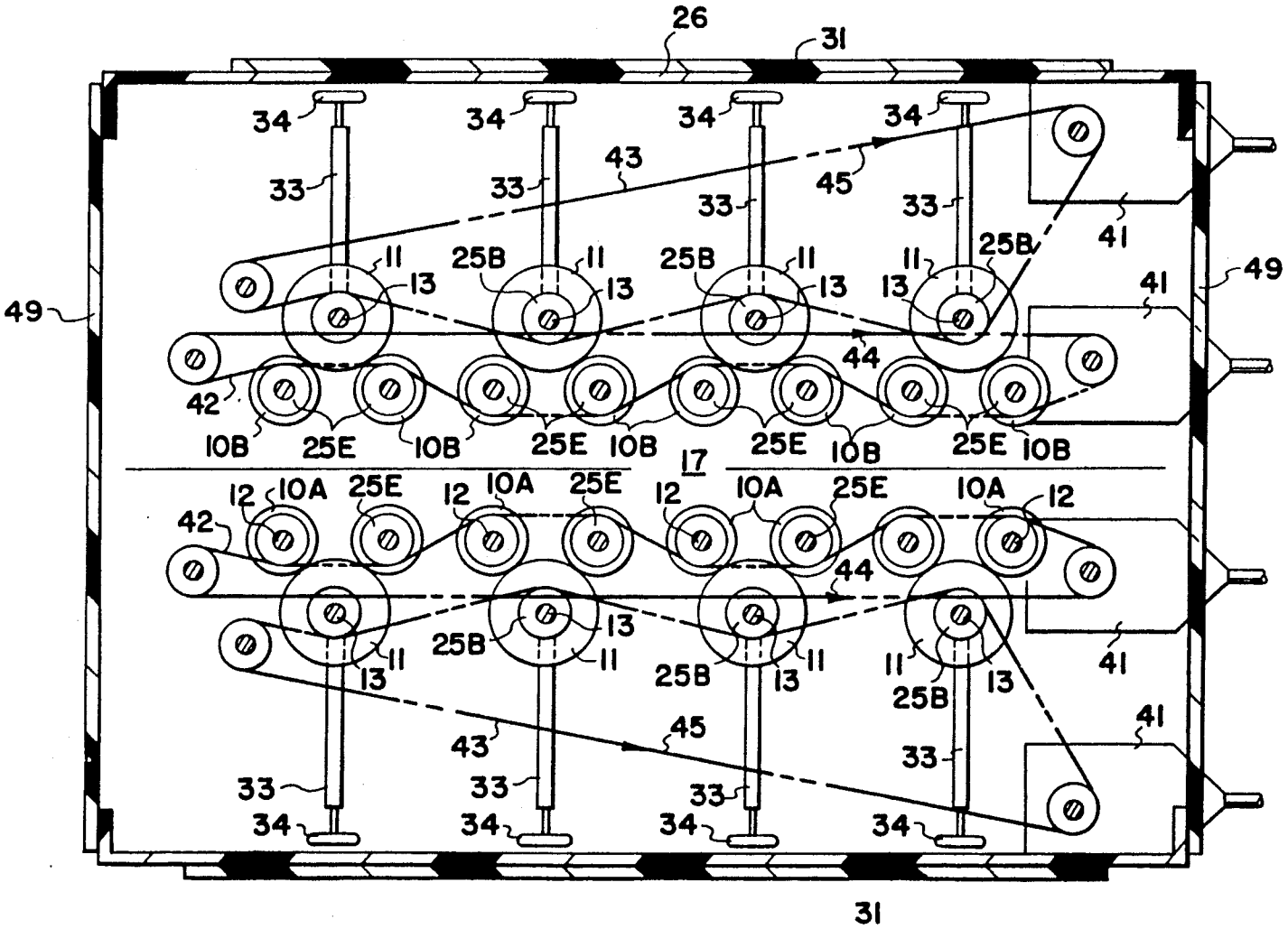
FIG. 3 is a cross sectional view taken at 3--3 of FIG. 2.

The entire apparatus with the possible exception of motors 24 is covered with a housing 26 extending from inlet port 39 to chutes 21 and 20. Housing 26 includes outer walls and an inner layer of heat insulation. Housing 26 is a clam-shell covering in that it consists of two sidewalls 31 but no end walls joining the sidewalls 31. Housing 26 is made in this design so that sections of the apparatus can be joined end-to-end to produce whatever length of treating apparatus is desired. In FIG. 2 there are shown two such sections, each section being that as shown in FIG. 3 including eight electrodes 10 and four brushes 11 on each side of free fall zone 17. Housing 26 is eventually closed at each end by a panel 49 (See FIG. 3) to make a complete enclosure regardless of how many individual sections of apparatus are joined together. The interior space contains air that preferably is continuously moved from outlet ports 27 through a filter 60, a heater 61, a dehumidifier 62 and a blower 63, before being recycled through inlet ports 28. It is not necessary to the functioning of the apparatus of this invention that the air inside housing 26 is so purified and treated, but it greatly increases the efficiency to do so because it removes dust and other airborne matter which may be attracted to electrodes 10 and thereby interfere with the apparatus. This equipment for purifying the air can be built to be inside of or outside of the housing 26, but preferably is outside so as to be capable of being coupled to one outlet port 27 and one inlet port 28 for any number of apparatus sections.

There is also provided in this apparatus means to adjust the position of each brush 11 with respect to the electrodes 10 that are engaged by brush 11. At each end of each brush 11 the brush shaft 13 extends outwardly beyond the bristled portion of brush 11 and is seated in a socket means 50 that is capable of lateral movement. The exact details of the socket 50 are not important. It may include a roller or ball bearing, a gimbal, or the like. In any event the socket means 50 is capable of preventing any substantial vertical movement but may be moved horizontally, at least in the linear direction toward or away from the electrode or electrodes 10 it is intended to contact. Joined to the socket means 50 is connector 33 extending laterally to housing 26, and terminating in a handwheel 34. Connector 33 and handwheel 34 are operably joined by screw threads such that turning handwheel 34 causes connector 33 to protract towards brush shaft 13 or by reversing the turning to retract connector 33 away from brush shaft 13. This adjustment feature allows the operator to adjust brush 11 with respect to electrodes 10 to provide the desired brushing contact.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An apparatus for electrostatically separating a feed mixture of two types of particles which comprises feeding the particles into the upper feed end of vertical free fall zone having an upper feed end and a lower discharge end between two horizontally spaced rows of a plurality of spaced rotating vertical axis elongated cylindrical electrodes, said lower discharge end having a splitter coextensive with said discharge end, and recovering two separated products each of different types of particles originally in said feed mixture, said rotating electrodes in each of said two rows being continuously cleaned by a plurality of vertically positioned, rotating, elongated cylindrical brushes contacting said electrodes in each of said two rows, and means for rotating said electrodes and said brushes, and means for applying an electric charge to each of said electrodes in each of said two rows, said electrodes and said brushes contacting said electrodes rotating in opposite directions with respect to each other.

2. The apparatus of claim 1 wherein said electrodes and brushes cooperate in units of two said electrodes for each one said brush.

3. The apparatus of claim 1 which additionally comprises an open-ended housing of two joinable side walls extending half way across the top and half way across the bottom to enclose said apparatus except for two open ends that are closeable by panels attachable to said side walls.

4. The apparatus of claim 3 which is horizontally extendible by joining said sidewalls of one said apparatus to corresponding sidewalls of another said apparatus and closing the open ends with said panels.

5. An apparatus unit comprising the apparatus of claim 2 with each said row of electrodes having eight identical electrodes and four identical brushes, each said brush contacting both of an adjacent pair of said electrodes, said unit including an open ended housing of two clam shell joinable sidewalls extending part way across the top and part way across the bottom to enclose said apparatus unit except for open ends which are closeable by attachable panels.

6. The apparatus of claim 1 wherein said means for rotating includes motors, sprockets, and chains connecting a plurality of said electrodes into a first circuit and motors, sprockets and chains connecting a plurality of said brushes into a second circuit.

7. The apparatus of claim 1 which includes manually adjustable means for positioning said brushes with respect to said electrodes.

8. The apparatus of claim 1 which additionally includes a means to vibrate said feed mixture as it is being introduced into said free fall zone.

9. An apparatus for electrostatically separating two types of particles from a mixture thereof, which comprises introducing a mixture of a plurality of electrostatically separable particles into the upper end of a free fall zone defined by two identical horizontally spaced rows of spaced elongated cylindrical electrodes positioned with their long axes vertical and with each electrode rotating about its long axis; a plurality of elongated cylindrical brushes positioned with their long axes vertical, each said brush rotating about its long axis and with its outer surface in brushing contact with one of said electrodes on a side of said electrode generally opposite to said free fall zone, said brush and said electrode being contacted by said brush rotating in opposite directions with respect to each other, a splitter located at the bottom of said free fall zone to direct one type of separated particle from the remainder of said mixture, electrical means to charge said electrodes, and motor driven means for rotating said electrodes in respective said rows in the same direction and for rotating said brushes contacting said electrodes in respective said rows in a direction opposite thereto.

10. The apparatus of claim 9 wherein said motor driven means includes a first set of chains and sprockets to drive a plurality of electrodes from a single motor source and a second set of chains and sprockets to drive a plurality of brushes from a single motor source.

11. The apparatus of claim 10 which additionally comprises manually adjustable means to individually adjust the contact between a brush and its cooperating electrode.

12. The apparatus of claim 9 wherein two adjacent said electrodes in respective said row are brushed by a single said brush.

13. The apparatus of claim 12 wherein said two electrodes rotate in the same one direction and the brush rotates in the opposite direction.

14. The apparatus of claim 9 which includes a clam shell housing of two opposed sidewalls with open end walls adapted to permit two or more said combinations of apparatus and housing to be joined end-to-end to produce a multiple capacity apparatus.

15. An apparatus for electrostatically separating a feed fixture of two types of particles which comprises a vertical free fall zone having an upper feed end for receiving mixed particles, and a lower discharge end through which separated particles pass, two horizontally oppositely spaced rows of a plurality of spaced rotating vertical axis elongated cylindrical electrodes on respective facing sides of said free fall zone, said lower discharge end having a splitter coextensive with said discharge end for recovering two separated products each of different types of particles originally in the feed mixture, means for applying an electric charge to said electrodes, a plurality of vertically positioned rotating elongated cylindrical brushes contacting said electrodes for cleaning particles therefrom and removing same from said apparatus, and means for rotating said electrodes and said brushes said brushes are enlarged radially with respect to said electrodes, each said brush engaging two of said electrodes spacedly away from said free fall zone to simultaneously cleaning same.

16. The apparatus of claim 15 wherein said electrodes and said brushes rotate in opposite directions with respect to each other.

17. The apparatus of claim 15 further comprising means for adjustably mounting said brushes for adjusting the contact of each said brush with each of said electrodes being contacted thereby.

* * * * *